US007926432B2

(12) United States Patent
Maringo et al.

(10) Patent No.: US 7,926,432 B2
(45) Date of Patent: Apr. 19, 2011

(54) LOW $NO_x$ CYCLONE FURNACE STEAM GENERATOR

(75) Inventors: Gerald J. Maringo, Jackson Township, Stark County, OH (US); George H. Harth, III, Wadsworth, OH (US); Manvil O. Dahl, Lake Township, Stark County, OH (US); Linda P. Dahl, legal representative, Lake Township, Stark County, OH (US); Steven W. Burge, Cuyahoga Falls, OH (US); Rosemary Burge, legal representative, Cuyahoga Falls, OH (US); Mitchell W. Hopkins, Lake Township, Stark County, OH (US)

(73) Assignee: Babcock & Wilcox Power Generation Group, Inc.

( * ) Notice: Subject to any disclaimer, the term of this patent is extended or adjusted under 35 U.S.C. 154(b) by 344 days.

(21) Appl. No.: 11/720,506

(22) PCT Filed: Feb. 6, 2006

(86) PCT No.: PCT/US2006/004216

§ 371 (c)(1),
(2), (4) Date: Jan. 25, 2008

(87) PCT Pub. No.: WO2006/086360

PCT Pub. Date: Aug. 17, 2006

(65) Prior Publication Data

US 2008/0127869 A1 Jun. 5, 2008

(51) Int. Cl.
*F23D 1/02* (2006.01)

(52) U.S. Cl. ..... 110/347; 110/264; 110/265

(58) Field of Classification Search ..... 110/260, 110/261, 263, 264, 265; 431/8, 9, 10, 173, 431/174, 177, 178, 179, 284, 285; 60/733, 60/747

See application file for complete search history.

(56) References Cited

U.S. PATENT DOCUMENTS 2,918,024 A * 12/1959 Seidl ..... 110/264
5,417,564 A * 5/1995 Briggs ..... 110/263
6,237,513 B1 * 5/2001 Tobiasz et al. ..... 110/347
6,490,985 B2 * 12/2002 Yamamoto et al. ..... 110/347

* cited by examiner

*Primary Examiner* — Kenneth B Rinehart
*Assistant Examiner* — David J Laux
(74) *Attorney, Agent, or Firm* — Eric Marich

(57) ABSTRACT

A low $NO_x$ Cyclone furnace steam generator including redesigned or modified Cyclone furnaces, air flow distribution, and new or relocated air ports maintains and/or minimizes $NO_x$ emission levels from the Cyclone furnace steam generator while minimizing Cyclone furnace and steam generator furnace tube wastage.

22 Claims, 6 Drawing Sheets

LOW $NO_x$ CYCLONE FURNACE STEAM GENERATOR

FIELD AND BACKGROUND OF THE INVENTION

The present invention relates, in general, to steam generators which combust fuels and which are used for the production of steam for industrial uses or electric power generation. In particular, the present relation relates to a low $NO_x$ Cyclone furnace steam generator and a method of operating same which employs in various combinations redesigned or modified Cyclone furnaces, new and/or relocated air ports, and different operating methods for these Cyclone furnaces and the steam generator. These features can maintain and/or reduce $NO_x$ emission levels from the steam generator while minimizing corrosion problems which might otherwise lead to major Cyclone furnace and steam generator tube wastage.

Cyclone furnaces were developed by The Babcock & Wilcox Company (B&W) in the USA in the 1940's. These Cyclone furnaces had the ability to burn high-ash low-fusion temperature coals, which are particularly troublesome in pulverized coal boilers. The Cyclone furnace utilizes centrifugal forces to suspend burning fuel particles, according to their size, in equilibrium against the drag of inwardly directed air flow. The Cyclone furnace has been used with various boiler types manufactured by The Babcock & Wilcox Company including: Stirling (SPB), Radiant Boiler (RB) and Universal Pressure (UP®) boilers, the latter including both subcritical and supercritical designs.

The Cyclone furnace (as schematically shown in FIG. 1) consists of a Cyclone burner connected to a horizontal water-cooled cylinder, the Cyclone barrel. Air and crushed coal are introduced through the Cyclone burner into the Cyclone barrel. The larger coal particles are thrust out to the barrel walls by the cyclonic motion of combustion air where they are captured and burned in the molten slag layer that is formed; the finer particles burn in suspension. The mineral matter melts and exits the Cyclone furnace via a tap at the Cyclone re-entrant throat that leads to the floor and then to a water-filled slag tank (not shown). The combustion gases and remaining ash leave the Cyclone furnace and enter the main combustion chamber. For additional details and a general description of the characteristics of such Cyclone furnaces, the reader is referred to the following sources of information: Chapter 14 of *Steam/its Generation and Use,* 40th Edition, Stultz and Kitto, Eds., © 1992 The Babcock & Wilcox Company; Chapter 10 of *Steam/its Generation and Use,* 39th Edition, © 1978 The Babcock & Wilcox Company; Chapter 10 of *Steam/its Generation and Use,* 38th Edition, © 1972 The Babcock & Wilcox Company; and Chapter 28 of *Steam/its Generation and Use,* 37th Edition, © 1963 The Babcock & Wilcox Company, the texts of which are hereby incorporated by reference as though fully set forth herein.

Air staging techniques have been used to reduce the production of nitrogen oxides or $NO_x$ from steam generators employing such Cyclone furnaces. As described in a technical paper titled "B&W's Advances on Cyclone $NO_x$ Control Via Fuel and Air Staging Technologies" by Farzan et al., presented to the EPRI-DOE-EPA Combined Utility Air Pollutant Control Symposium, Aug. 16-20, 1999 in Augusta, Ga., the basic theory of air staging is to reduce the fuel $NO_x$ component within the burner zone by reducing oxygen availability. Additionally, the thermal $NO_x$ component will be lowered because of the lower combustion gas temperatures. This latter aspect is significant for steam generators equipped with Cyclone furnaces because the thermal $NO_x$ component is typically higher than that obtained with other firing techniques. Finally, due to the inherent combustion characteristics of Cyclone-equipped furnaces during staged operation, specific gas species are formed in the lower furnace to promote reburning technology NOx reduction reactions to occur. Cyclone furnace air staging involves reducing the combustion air provided to the Cyclone furnaces and operating the Cyclone furnaces at reduced stoichiometries, typically at a stoichiometry of about 0.90 to 1.00 (less air than is theoretically required for complete combustion). The balance of the theoretical air required for complete combustion, as well as the excess air normally supplied in such combustion processes, is introduced into the main combustion chamber of the steam generator via overfire air (OFA) ports located at a higher elevation than the Cyclone furnaces. As a result, Cyclone air staging employs multiple combustion zones within the main combustion chamber of the steam generator, defined as the main combustion (Cyclone region) and burnout (OFA ports to the furnace exit) zones.

As described in the aforementioned STEAM references, the Cyclone furnaces themselves operate at extremely high heat release rates and with a molten sticky slag layer over a refractory lining which both protects the water-cooled walls of the Cyclone barrel and minimizes heat absorption, thereby assisting in this molten slag remaining in that state so that it can continuously flow out the slag tap into the slag tank (not shown). Thus, Cyclone furnace operation is a unique combustion process. While air staging technology has been successfully used to reduce $NO_x$ emission levels from Cyclone fired steam generators, operation in this manner does create potentially negative effects, including higher unburned carbon levels, increased boiler fly ash percentages (higher particulate loading), increased steam generator slagging/fouling, increased corrosion and higher opacity levels. Of particular concern is the potential for reduced Cyclone furnace and lower/upper steam generator main combustion region life expectancy due to corrosion. Unfortunately, with staged combustion, the reduced amount of air supplied to the Cyclone furnaces creates a reducing atmosphere in the lower furnace that leads to furnace wall and floor wastage. The furnace walls of the lower furnace are routinely protected with studs and refractory coating. Refractory alone cannot always be maintained to address these problems. Depending on the individual Cyclone furnace and steam generator design operating temperature and pressure, these problems can be greatly magnified, especially when applying the air staging technology to reduce $NO_x$ emission levels.

To minimize the overall furnace wastage issue, some operators of steam generators employing Cyclone furnaces have increased the air flow to the Cyclone furnace to help minimize these concerns, but unfortunately, this mode of operation also increases the resulting $NO_x$ emission levels. Dealing with the increased NOx emission levels could require more costly alternative $NO_x$ control measures, and could involve the provision of additional $NO_x$ removal equipment downstream. To deal directly with the increased corrosion potential within the Cyclone furnaces and the main combustion region of the steam generator, higher cost alternative furnace wall stud and tube materials and/or refractory and/or protective coatings could be employed. However, it is apparent that no proven approach has been provided that can maintain or even lower the $NO_x$ emissions from such Cyclone fired steam generators while minimizing these other related negative consequences of furnace tube wastage.

SUMMARY OF THE INVENTION

The present invention provides a low-cost Cyclone furnace steam generator design improvement that permits operation of such Cyclone fired steam generators with the desirable combination of low $NO_x$ emission levels while reducing the furnace wastage problems associated with staged combustion in such Cyclone furnaces and their associated steam generators. Improved Cyclone furnace combustion operation is also a side benefit.

Accordingly, one aspect of the present invention is drawn to a method of operating a Cyclone furnace steam generator having front, rear and side walls and one or more Cyclone furnaces for combusting a fuel. The Cyclone furnaces are arranged along at least one of the front and rear walls of the steam generator, and a plurality of over fire air (OFA) ports are arranged along at least one wall at a higher elevation above the Cyclone furnace(s). The method comprises the steps of: providing a portion of the total air for combustion to the Cyclone furnaces, outer Cyclone furnaces adjacent the side walls being provided with a higher air/fuel ratio than that air/fuel ratio provided to inner Cyclone furnaces located further away from the side walls. The balance of the total air for combustion is provided to the OFA ports.

Another aspect of the present invention is drawn to a low $NO_x$ Cyclone furnace steam generator, comprising a steam generator having front, rear and side walls and one or more Cyclone furnace(s) for combusting a fuel. The Cyclone furnaces are arranged along at least one of the front and rear walls of the steam generator, and a plurality of over fire air (OFA) ports are arranged along the at least one wall at a higher elevation above the plurality of Cyclone furnaces. Lower furnace air ports are provided adjacent the side walls for providing a portion of the total air for combustion into the steam generator along said side walls.

The invention is intended to provide a newly designed low NOx Cyclone burner system including redesigned or modified Cyclone furnaces, air flow distribution, and new or relocated air ports to maintain and/or minimize NOx emission levels from a Cyclone-fired boiler while minimizing major cyclone/furnace tube wastage problems. The arrangement of the existing Cyclone furnaces and OFA system would be modified to address the issues stated.

The addition of strategically located front and rear wall air ports to help provide combustion air to unburned combustibles and corrosive gas species that are exiting the Cyclone furnaces are included to help destroy some of the negative components that cause the sidewall wastage problems. The new port design incorporates features for effective mixing and also being able to survive and operate in the severe environment that exists in this lower furnace region. The ports would use secondary air flow at the optimum rates to achieve this goal. The port features can include adjustable vanes to optimize air flow direction, dampers to regulate flow, and anti-slag casting components to redirect slag flow around the port, thus keeping the port clear (operational).

Optimizing the air/fuel ratio at each Cyclone furnace is required to minimize the corrosion causing components leaving the Cyclone furnace and entering the lower furnace region, especially near the boiler sidewalls. Increasing the local stoichiometry along the sidewalls by increasing the operating air to fuel ratio on each of the Cyclone furnaces closest to the sidewalls is required. Reducing the Cyclone furnace stoichiometries on the internal Cyclone furnaces is then accomplished by decreasing the air to fuel ratio on the inside Cyclone furnace. The overall global lower furnace stoichiometry is thus maintained at the same condition as originally started (or could be even slightly lessened); to assure that at least the same overall $NO_x$ leaving the boiler is maintained, if not reduced. This is required due to the highly turbulent nature of the flow out of the Cyclone furnace, thus assuring that the local stoichiometry is maintained higher near the sidewalls.

Lastly, improving the Cyclone combustion process will also help to minimize the negative components entering into the furnace region and allow each Cyclone to operate in its most efficient condition. Optimizing the design of the outer and inner Cyclone location reentrant throats will optimize combustion and maintain similar operating conditions for each. The outermost Cyclones that may operate at higher air to fuel rates may be designed with larger re-entrant throat open diameters. The inner Cyclones, which may operate at lower air to fuel ratios, may be designed with smaller re-entrant throat open diameters. Providing these design changes will ensure that good combustion uniformity is maintained from Cyclone to Cyclone.

The various features of novelty which characterize the invention are pointed out with particularity in the claims annexed to and forming a part of this disclosure. For a better understanding of the invention, its operating advantages and the specific benefits attained by its uses, reference is made to the accompanying drawings and descriptive matter in which preferred embodiments of the invention are illustrated.

DESCRIPTION OF THE PREFERRED EMBODIMENTS

Figure 1:
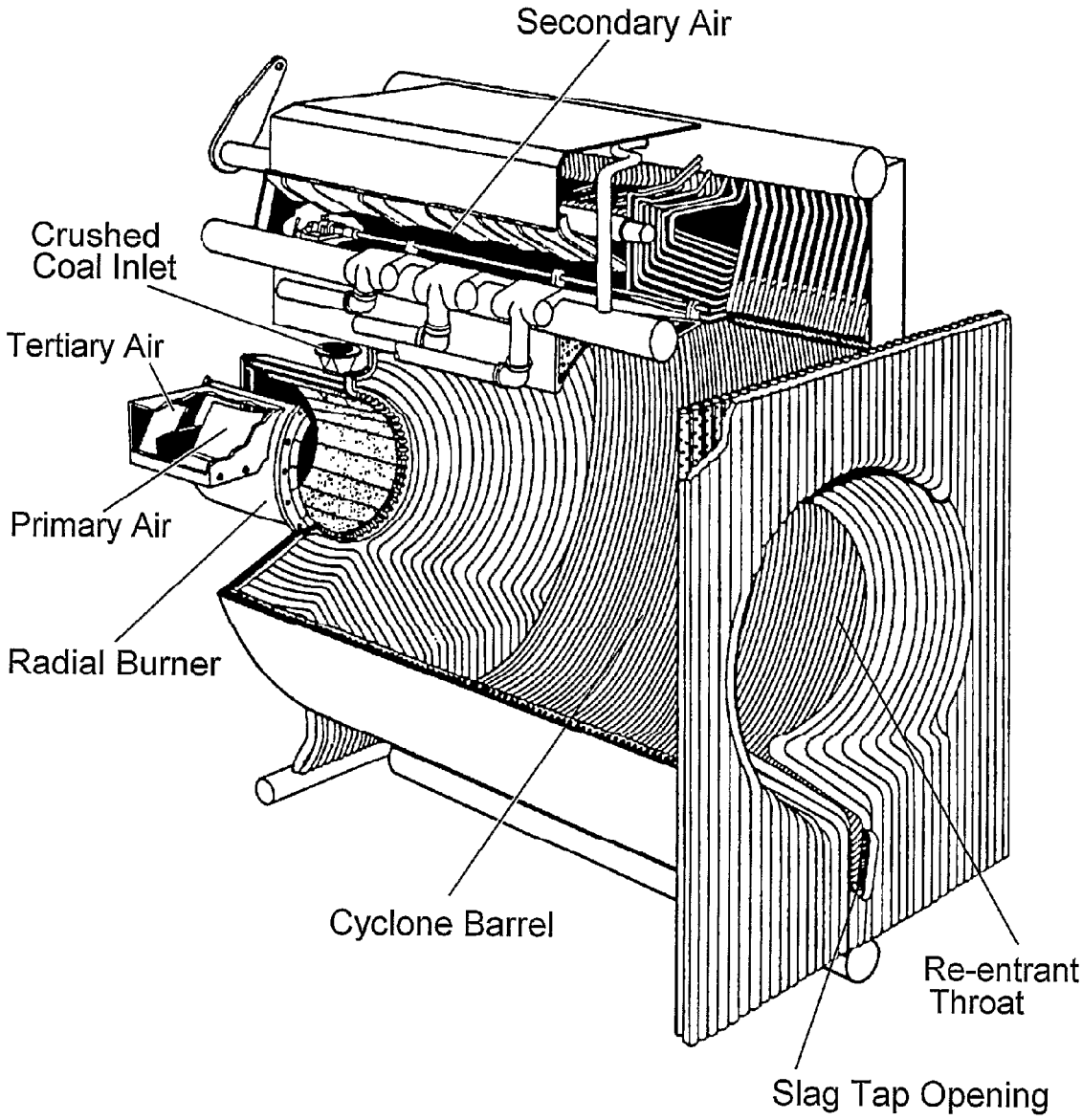
FIG. 1 PRIOR ART
FIG. 1 is a schematic perspective view, partly in section, of a typical prior art Cyclone furnace manufactured by The Babcock & Wilcox Company.
Figures 2, 2A, 2B:
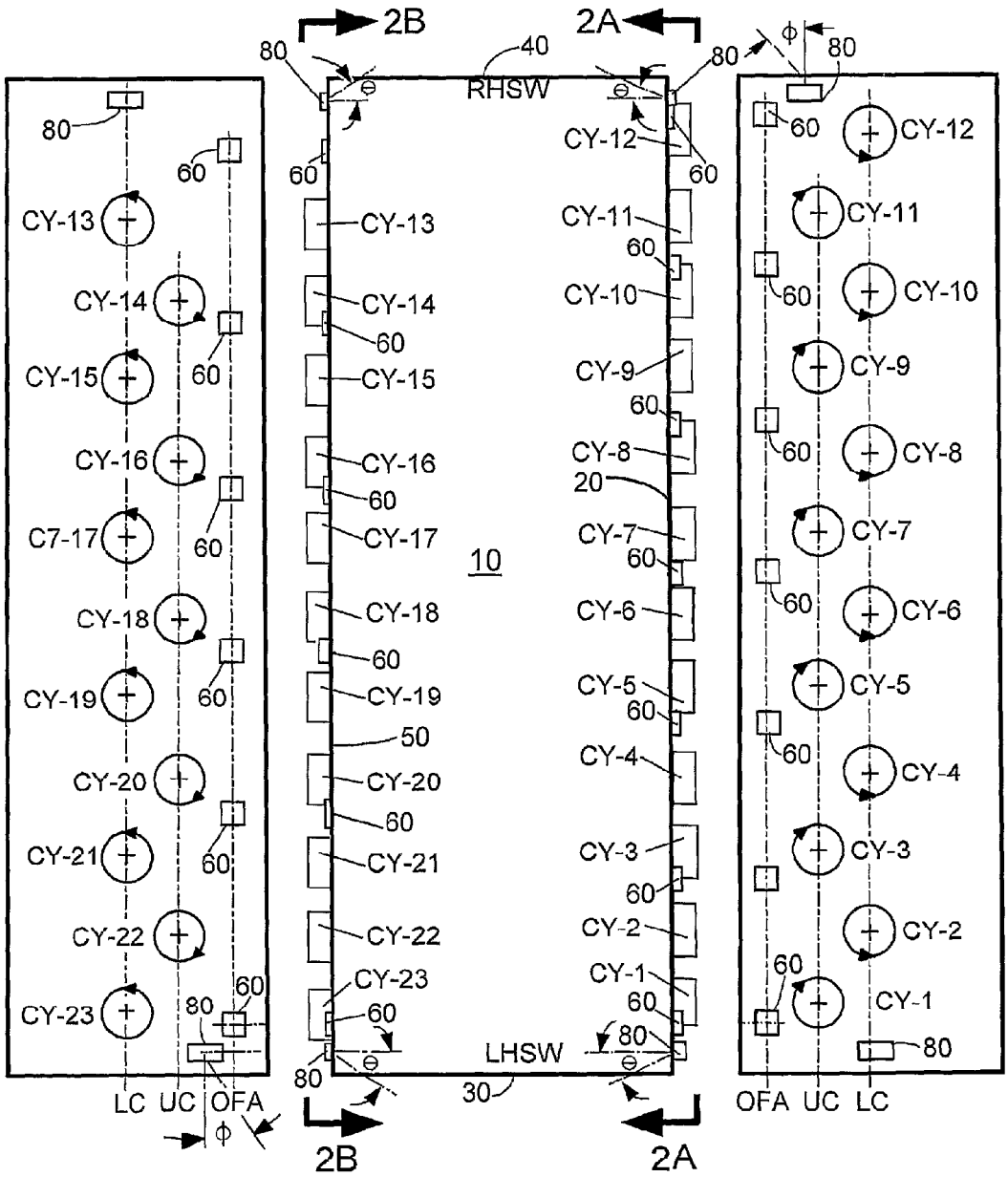
FIG. 2 is a schematic plan view of a steam generator furnace provided with Cyclone furnaces and an air staging system for NOx control according to an embodiment of the invention.
FIG. 2A is a schematic front view of the steam generator furnace of FIG. 2 provided with an array of over fire air (OFA) ports and Cyclone furnaces of the air staging system for NOx control as they are installed so as to deliver air and fuel, respectively, into the steam generator furnace, viewed in the direction of arrows 2A-2A of FIG. 2, according to an embodiment of the invention.
FIG. 2B is a schematic rear view of the steam generator furnace of FIG. 2 provided with an array of over fire air (OFA) ports and Cyclone furnaces of the air staging system for NOx control as they are installed so as to deliver air and fuel, respectively, into the steam generator furnace, viewed in the direction of arrows 2B-2B of FIG. 2, according to an embodiment of the invention.

Referring to the drawings generally, wherein like reference numerals designate the same or functionally similar elements throughout the several drawings, and to FIG. 2 in particular, there is shown a schematic plan view of a steam generator furnace 10 having a front wall 20, left hand side wall 30, right hand side wall 40 and rear wall 50. Adjacent each of the front wall 20 and rear wall 50 is a schematic representation of an array of over fire air (OFA) ports 60, and Cyclone furnaces 70 as they are installed so as to deliver air and fuel, respectively, into the steam generator furnace 10. FIGS. 2A and 2B are schematic front and rear views, respectively, of the steam generator furnace of FIG. 2 as provided with the array of over fire air (OFA) ports and Cyclone furnaces of the air staging system for NOx control as they are installed so as to deliver air and fuel, respectively, into the steam generator furnace, viewed in the direction of arrows 2B-2B of FIG. 2, according to an embodiment of the invention. The square boxes represent the OFA ports 60, while the circles represent the Cyclone furnaces 70. It will be noted that the OFA ports are arranged at an uppermost elevation on each of the front 20 and rear 50 walls, while the Cyclone furnaces occupy two lower elevations on said front and rear walls 20, 50. The upper elevation of Cyclone furnaces 70 is designated "UC" in FIGS. 2A and 2B, while the lower elevation of Cyclone furnaces 70 is designated "LC" in FIGS. 2A and 2B. As is known to those skilled in the art, Cyclone furnaces 70 may be provided with a right or left hand orientation with respect to a direction of rotation or swirl of the fuel and air mixture within the Cyclone furnace 70, and that direction of swirl or rotation is schematically designated in FIGS. 2A and 2B by the arrows on the perimeter of each circle designating an individual Cyclone furnace 70. The present invention is not limited to a steam generator furnace 10 having the specific number of Cyclone furnaces 70 and OFA ports 60 shown in the Figs.; the principles of the present invention may be applied to those steam generator furnaces 10 having more or fewer Cyclone furnaces 70 and OFA ports 60, arranged in single or multiple rows and with either direction of rotation or swirl. Similarly, the present invention may be applied to steam generator furnaces 10 which are of the single wall firing type, rather than the opposed firing type illustrated.

The use of a Computational Fluid Dynamic (CFD) numerical model provides detailed boiler equipment performance information that cannot be obtained solely through physical modeling or field measurements. Physical modeling cannot account for the extreme temperature variations within boiler equipment and is subject to the physical compromises of a reduced geometric scale. Field measurements provide actual performance data but are limited to few locations from which interpretations must be made. Further, it is not practical (from the standpoint of either time or money) to evaluate multiple hardware design options (such as pressure part changes) using field measurements. Numerical modeling provides additional information to the design engineering team. The best chance of design optimization occurs when modeling results are used in conjunction with experience, traditional performance predictions, physical flow modeling, and field measurements.

Figure 3:
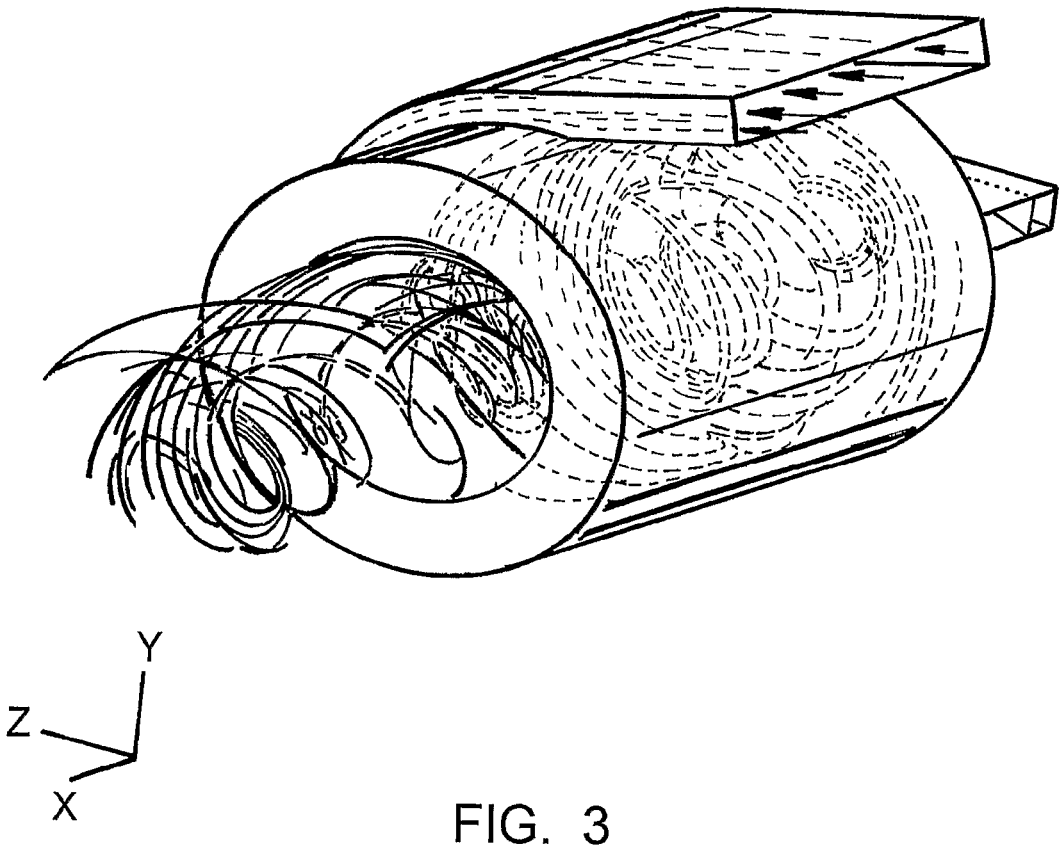
FIG. 3 is a Computational Fluid Dynamics (CFD) model of a typical Cyclone furnace 70 used in the development of the present invention.

Utilizing a proprietary CFD modeling program, the present inventors modeled an existing steam generator furnace 10 under various operating conditions and arrangements to evaluate the potential to minimize corrosive gas species in lower furnace regions of the steam generator furnace 10 while maintaining low $NO_x$ emission level potential. A two step modeling procedure was used during the investigations. First, the flow conditions at the Cyclone furnace 70 throats were predicted. The purpose of this step was to develop flow conditions in the throats that can be mapped onto the furnace model, utilized in a second step. A CFD model of a typical Cyclone furnace 70, as illustrated in FIG. 3, was developed and run for a variety of conditions. Input to this model included coal and air flow rates and coal composition. Flow, temperature, and species concentrations were then predicted throughout the Cyclone furnace 70. Once this was completed, a CFD model of the steam generator furnace 10 was developed and the Cyclone furnace 70 outlet conditions were mapped into the CFD model of the steam generator furnace 10. The furnace model started at the Cyclone furnace 70 re-entrant throat outlets and extended beyond the steam generator furnace arch (not shown in the Figs.). The predicted conditions entering the steam generator furnace 10 from the Cyclone furnaces were taken from the Cyclone furnace 70 model (step 1 above). Predicted gas species concentrations for various test cases were determined and evaluated throughout lower and upper regions of the steam generator furnace 10.

Utilizing the above modeling procedures, a baseline condition was generated (firing a specified bituminous coal and operating in a typical air staging/OFA system mode). The furnace mapping provided the base gas species information from which the subsequent improved arrangement would be compared. The gas species of interest was CO, since this gas species has been associated with sidewall wastage problems and can be used to predict the presence of additional corrosive species. A variety of test conditions with numerous design arrangements were identified and run in the model. The results of the modeling did positively prove the concept. Modifying (customizing) the Cyclone furnace 70 re-entrant throats, optimizing the air fuel ratios within each of the Cyclone furnaces 70, and modifying the introduction of the OFA flow into the steam generator furnace 10 resulted in dramatic improvements near the furnace walls in the concentrations of gas species that accelerate furnace wall wastage.

In accordance with a first embodiment of the invention, the Cyclone furnaces 70 of the steam generator furnace 10 are operated in an air staging mode of operation, with the total amount of combustion air supplied to the Cyclone furnaces 10 being overall a sub-stoichiometric amount, with the balance of the combustion air being admitted into the steam generator furnace 10 via the OFA ports 60, but in contrast to prior art operation the Cyclone furnaces 70 are not all operated at the same stoichiometry. Instead, the air/fuel ratio at each Cyclone furnace 70 is optimized as required to minimize the corrosion causing components leaving each Cyclone furnace 70 and entering the lower furnace region of the steam generator furnace 10, especially near the steam generator furnace left and right hand side walls 30, 40 respectively. In particular, this is accomplished by increasing the local stoichiometry along each of the left and right hand side walls by increasing the operating air to fuel ratio on each of the "outer" Cyclone furnaces 70 closest to the left and right side walls 30, 40; for example, on CY-1 and CY-2; CY-11 and CY-12; CY-13 and CY-14; and CY-22 and CY-23. At the same time, the stoichiometries on the remaining Cyclone furnaces 70 which are located farther away from the side walls 30, 40 are reduced by decreasing the air to fuel ratio on these "inside" Cyclone furnaces 70. However, the overall "global" lower furnace stoichiometry is thus maintained at the same conditions as originally contemplated for the conventional air staging mode of operation (or the global lower furnace stoichiometry could be even slightly lessened), to ensure that at least the same overall $NO_x$ levels leaving the steam generator furnace 10 are maintained, if not reduced. This is required due to the highly turbulent nature of the flow of gases out of the Cyclone furnaces 70, thus assuring that the local stoichiometry adjacent the side walls is maintained at higher levels than before, decreasing the locally reducing conditions that could otherwise contribute to furnace tube corrosion and wastage. Thus, for a given initial case where the total air for combustion is a stoichiometry of 1.20, and all the Cyclone furnaces 70 are operated at a stoichiometry of 0.95, with the balance of 0.25 provided via the OFA ports 60, the "inner" Cyclone furnaces 70 may instead be operated at a stoichiometry of 0.90, the "outer" Cyclone furnaces 70 operated at a stoichiometry of 1.05, and the balance of the total air for combustion is provided via the OFA ports 60 as before.

According to a second embodiment of the present invention, strategically located air ports 80 are added in the lower region of the steam generator furnace 10 to help provide combustion air to any unburned combustibles and corrosive gas species that are exiting the Cyclone furnaces and help destroy some of those combustion components that can cause the side wall wastage problems. The air ports 80 are designed to survive the severe operating environment that exists in this lower furnace region and to which they will be subjected, and are provided with features for effective mixing into the flue gases within the steam generator furnace 10. The air ports 80 use secondary air flow at optimum rates to achieve this goal, and each air port 80 may be provided with adjustable vanes to optimize air flow direction. Provision for pitch adjustment (up and down) at a pitch angle Ø within a range of +45 to −45 degrees of horizontal may be provided. Provision for yaw adjustment (side to side) at a yaw angle θ of up to about 30 degrees with respect to a line perpendicular to a plane of the furnace wall on which they are installed may be provided. The air ports 80 may be installed on the front and/or rear walls 20, 30 adjacent the side walls 30, 40 as shown in FIGS. 2, 2A and 2B. Dampers may be provided to regulate air flow quantity through the air ports 80, and air flow measurement devices would also be provided to measure air flow through the air ports 80. The velocity of the air provided through the air ports 80 may advantageously be selected to ensure good penetration into the combustion flue gases in the furnace; velocities similar to those employed in the OFA ports of approximately 18,000 ft/min. may be utilized, or varied to suit given operating conditions. Anti-slag casting components may be provided at each air port 80 to redirect any slag flow around the air ports 80, thus keeping the air ports 80 clear and operational. Operationally, the air supplied through the air ports 80 is preferably taken from the air normally provided to the OFA ports 60. Thus, for a given initial case where the total air for combustion is a stoichiometry of 1.20, and all the Cyclone furnaces 70 are operated at a stoichiometry of 0.95, with the balance of 0.25 provided via the OFA ports 60, when air ports 80 are provided the Cyclone furnaces 70 are operated at a stoichiometry of 0.95, the OFA ports 60 are operated at a stoichiometry of 0.20, and the balance of the total air for combustion—0.05—is provided via the air ports 80.

Cyclone-equipped boilers have a unique characteristic whereas in order to maintain successful operation, the pressure drop across the Cyclone furnace (windbox to furnace pressure drop) needs to be maintained at (or at least close to) the full load pressure drop across the entire Cyclone boiler operating range. This is required to keep the condition of high velocity air flow into the Cyclone barrel, thus creating the highly turbulent, high temperature environment to allow the Cyclone furnace to maintain its required slagging capabilities. Other boiler types typically result in lower burner pressure drops as load is reduced (lower windbox to furnace pressure drops). This difference results in a unique operating scheme for Cyclone units whereas the windbox static pressure remains high over the entire boiler load range. With this available high windbox static pressure, if simple port openings with no controllability are included in the furnace walls and these openings are located within the Cyclone windbox, the resulting flow thru these ports would remain high over the steam generator's load range. This would be an undesirable operating condition, in as much as when load was reduced, a higher than desired percentage of flow to these ports would result. Thus, the present invention includes the capability to control flow to these ports over the steam generator's load range in order to maintain acceptable control of boiler operating excess air levels, acceptable furnace slagging conditions, CO and NOx emission levels, and general acceptable boiler performance.

In contrast, for other boiler types where the windbox static pressure is reduced with load, the port opening arrangement can be simplified and the flow does not necessarily have to have control capabilities (flow to the ports would be reduced at lower loads at similar rates as that to the burners, thus maintaining close to the same ratio of flow between the two as that required at full load). The present invention's utilization of multiple size reentrant throats on a multi-cyclone-equipped steam generator is an entirely new approach, and which provides for better control of the air flows to the various Cyclone furnaces while maintaining the individual Cyclone furnace secondary air (velocity) dampers at approximately the same % open position. By this design, combustion can be optimized in each Cyclone furnace while effectively operating at different air to fuel ratios (stoichiometries) in each of the Cyclone furnace regions. In addition, the operating performance and behavior of Cyclone fired steam generators is different from that with conventional pulverized coal firing in that Cyclone firing produces running slag on the walls in the lower furnace or combustion zone. This presents a different environment from that encountered in conventional pulverized coal firing which employed boundary air to reduce furnace tube wastage since those applications did not have to contend with wet running slag. The present invention takes advantage of these higher static pressures to have the air provided by the lower furnace air ports 80 penetrate into the lower furnace region and help protect the walls from corrosive gas species.

In a still further embodiment of the present invention, a combination of the above-identified methods of operation and the deployment of the air ports 80 may provide even greater operational flexibility to reduce tube wastage in the lower furnace region. Additionally, since the operating stoichiometries of the Cyclone furnaces 70 adjacent the side walls 30, 40 are different from those remaining Cyclone furnaces 70 which are located farther away from the side walls 30, 40, the opportunity to specifically design various aspects of the Cyclone furnaces 70 in one location versus those in another location presents itself. In particular, by improving the Cyclone furnace 70 combustion process to minimize the negative components entering into the steam generator furnace 10 allows each Cyclone furnace 70 to operate in its most efficient condition. Optimizing the design of the re-entrant throats of the Cyclone furnaces 70 which are provided at "outer" and "inner" locations will optimize combustion and maintain similar operating conditions for each Cyclone furnace 70. The "outer" Cyclone furnaces 70 that will operate at higher air to fuel ratios can be designed with larger re-entrant throat open diameters. The "inner" Cyclone furnaces, which will operate at lower air to fuel ratios, can be designed with smaller re-entrant throat open diameters. Combinations of these approaches may also be employed. Providing these design changes for these individual Cyclone furnaces 70 depending upon their location will ensure that good combustion uniformity is maintained from Cyclone furnace 70 to Cyclone furnace 70.

In yet another embodiment of the present invention, it may be possible to take advantage of the direction of swirl of the Cyclone furnaces 70 and utilize same to enhance the sweeping of adjacent side walls 30, 40 with combustion air to reduce the potential for localized reducing conditions. This would require such Cyclone furnaces 70 adjacent the side walls 30, 40 to have a direction of swirl different from the direction of swirl of the balance of the Cyclone furnaces 70 on a given wall and elevation. The particular direction of swirl, and the benefits to be attained through such a modification would be determined through CFD modeling as before.

The invention is intended to provide a low $NO_x$ Cyclone furnace system including redesigned or modified Cyclones, air flow distribution, and new or relocated air ports to maintain and/or minimize $NO_x$ emission levels from a Cyclone furnace steam generator 10 while minimizing major Cyclone/furnace tube wastage problems. Existing arrangements of Cyclone furnaces and OFA systems can be modified to address the issues stated.

Figure 4:
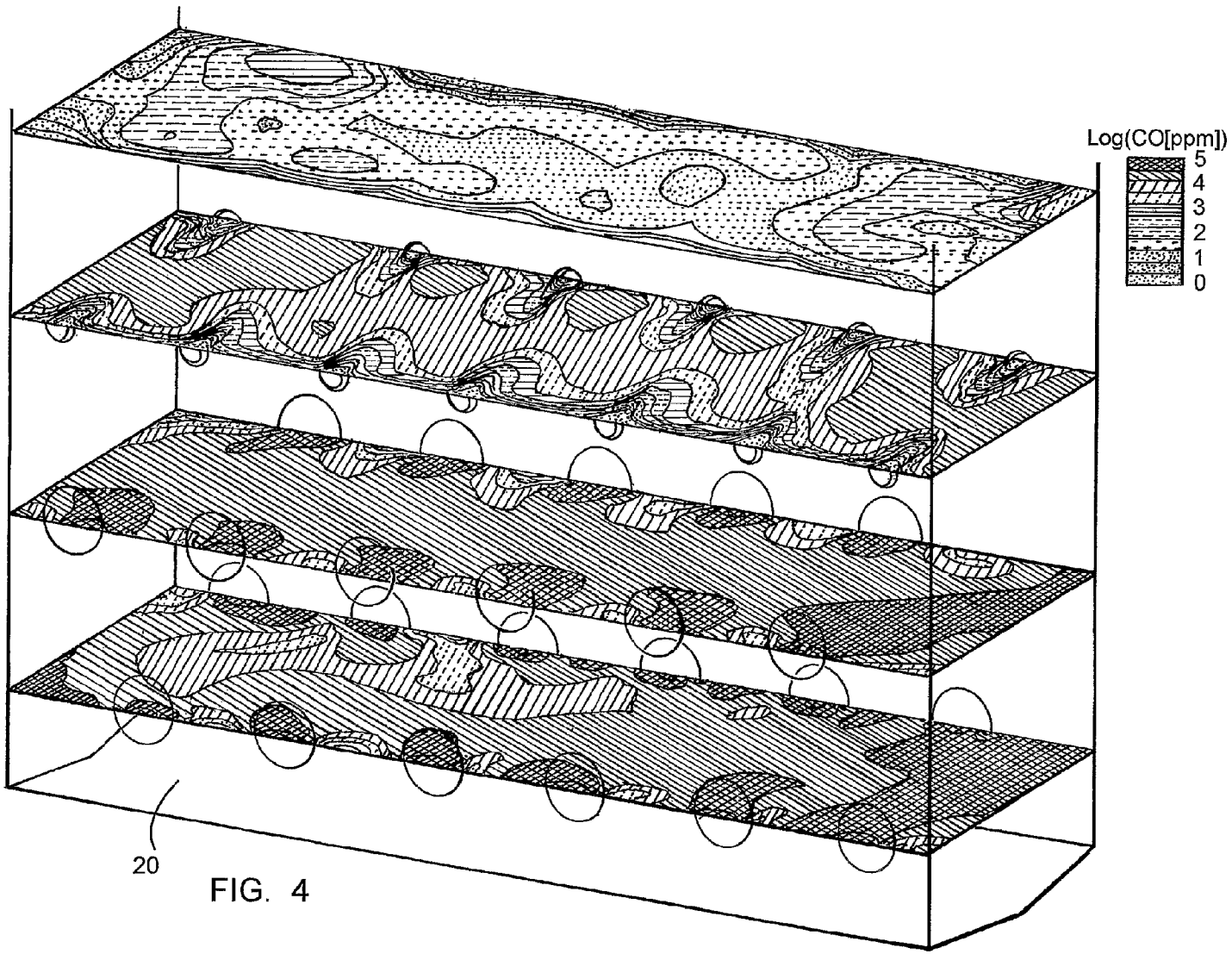
FIG. 4 is a CFD contour plot of base CO emissions produced by the steam generator furnace of FIG. 2.
Figure 5:
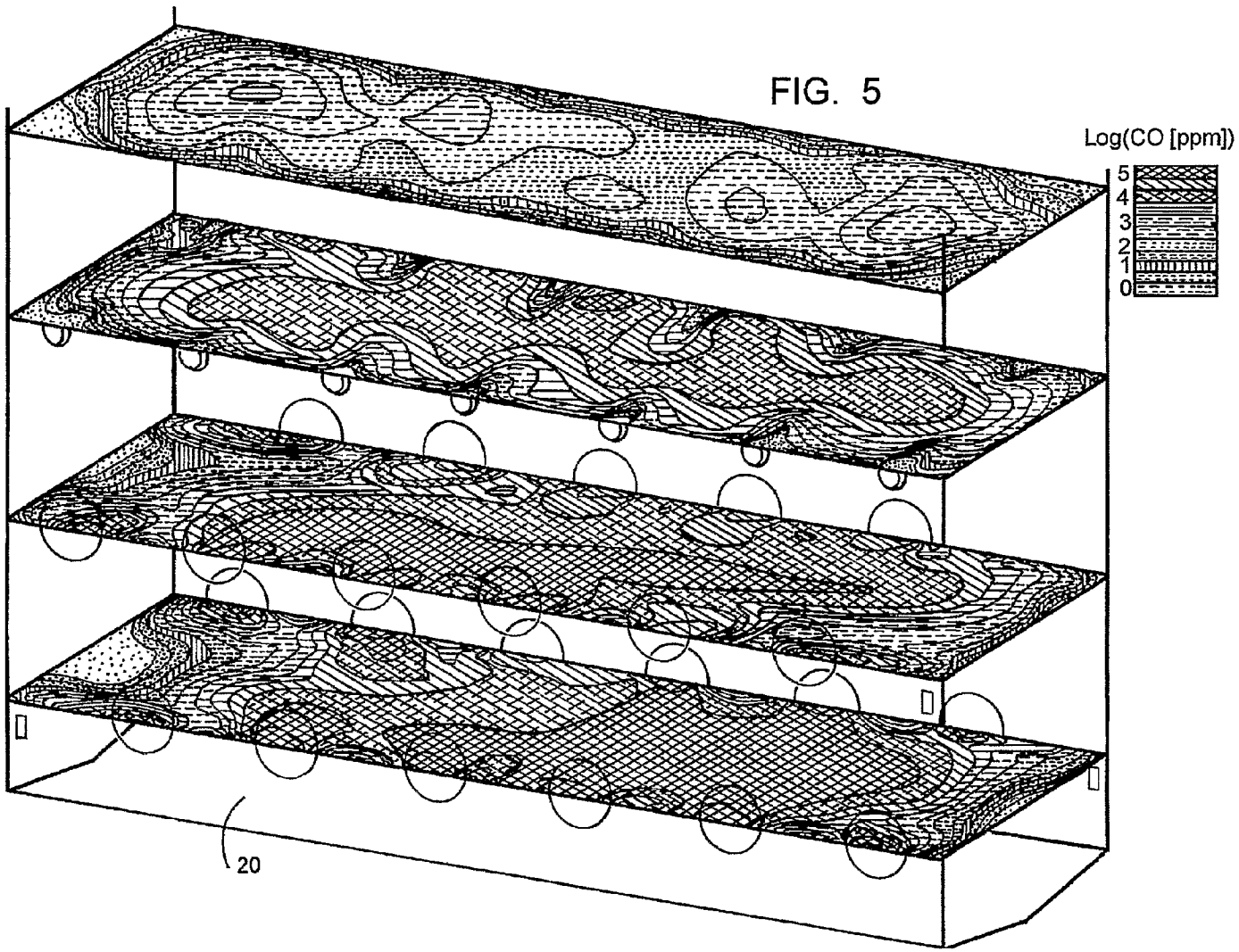
FIG. 5 is a CFD contour plot of CO emissions illustrating reduced CO emissions when a combination of features of the present invention are employed.
Figure 6:
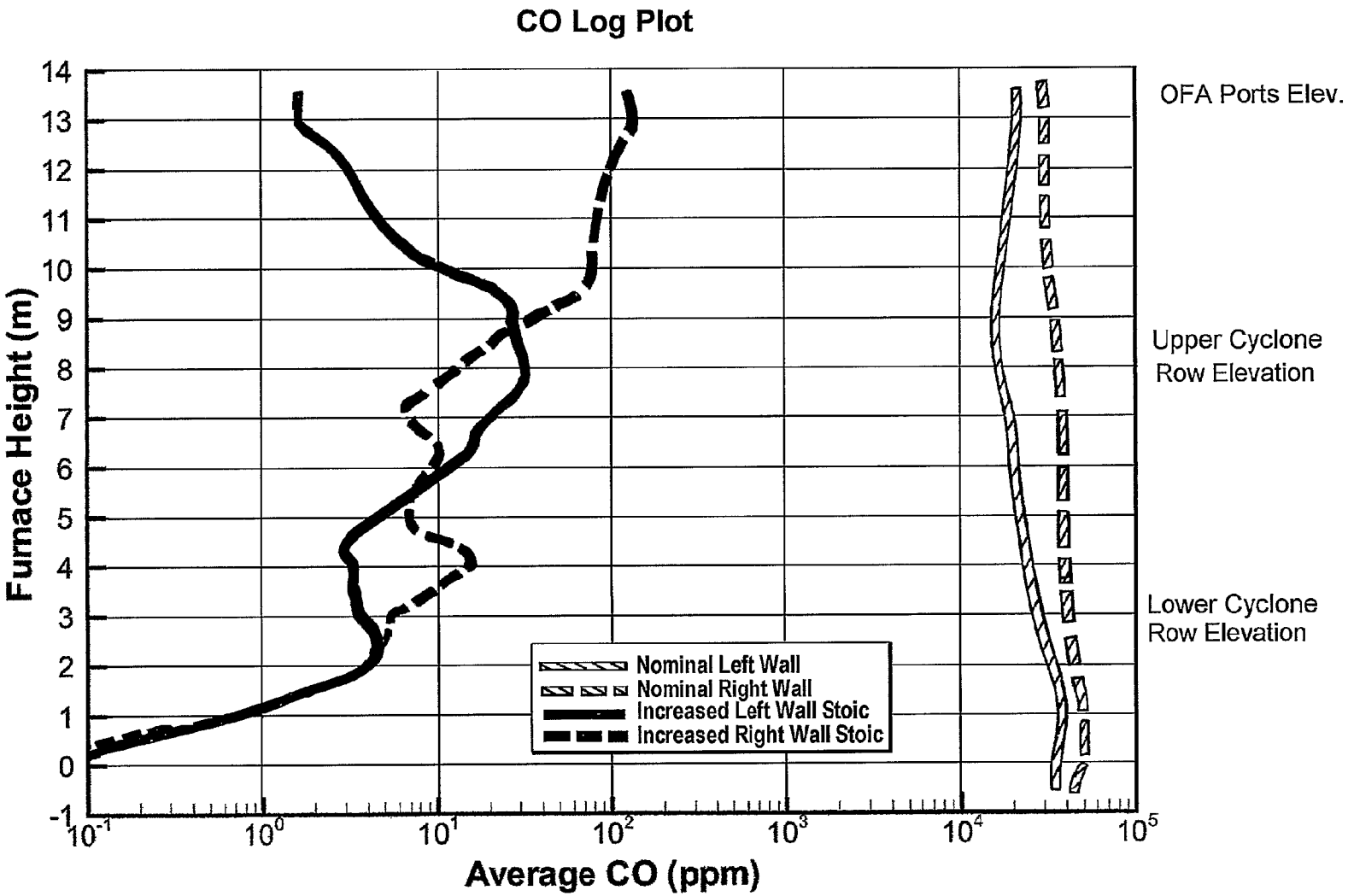
FIG. 6 is a CO log plot of average CO emissions versus furnace height corresponding to the contour plots for the base case of FIG. 4, without the benefit of the present invention, and for the case of FIG. 5 where a combination of features of the present invention are employed.

FIGS. 4 and 5 are contour plots of CO emissions based upon the CFD models described above. FIG. 4 represents the base case where all the Cyclone furnaces 70 are operated at a stoichiometry of 0.95, the balance of the air (0.25) is provided via the OFA ports 60, and there are no air ports 80. FIG. 5 represents a combined case where several features of the invention are employed. In particular, the inner [15] Cyclone furnaces 70 are operated at a stoichiometry of 0.90, the outer [8] Cyclone furnaces are operated at a stoichiometry of 1.00, and four (4) air ports 80 are provided with approximately less than 0.05 of the total air for combustion, the balance being supplied via the OFA ports 60. In addition, the case of FIG. 5 employs the aforementioned pitch and yaw adjustments; particularly, the upper air ports 80 are angled down at a pitch angle Ø of 45 degrees from the horizontal while the lower air ports 80 are angled towards their adjacent side walls 30 and 40 at a yaw angle θ of up to about 30 degrees from a direction perpendicular to the plane of the front or rear walls 20, 50. Finally, FIG. 6 is a CO log plot of average CO emissions near the steam generator sidewalls versus furnace height corresponding to the contour plots for the base case of FIG. 4, without the benefit of the present invention, and for the case of FIG. 5 where the combination of features of the present invention are employed.

While specific embodiments of the invention have been shown and described in detail to illustrate the application of the principles of the invention, those skilled in the art will appreciate that changes may be made in the form of the invention covered by the following claims without departing from such principles. For example, the present invention may be applied to new steam generator construction involving Cyclone furnaces, or to the replacement, repair or modification of Cyclone furnaces on existing steam generators. The types of steam generators to which the concepts of the present invention may be applied include any of the aforementioned Stirling (SPB), Radiant Boiler (RB) and Universal Pressure (UP®) boilers, the latter including both subcritical and supercritical designs. As described above, in some embodiments of the invention, certain features of the invention may sometimes be used to advantage without a corresponding use of the other features. Accordingly, all such changes and embodiments properly fall within the scope of the following claims.

We claim:

1. A method of operating a Cyclone furnace steam generator having front, rear and side walls and a plurality of Cyclone furnaces for combusting a fuel, the Cyclone furnaces arranged along at least one of the front and rear walls of the steam generator, and a plurality of over fire air (OFA) ports arranged along at least one of, or both of, the front wall and the rear wall at a higher elevation above the plurality of Cyclone furnaces, comprising the steps of:

providing a portion of the total air for combustion to the Cyclone furnaces, outer Cyclone furnaces adjacent the side walls being provided with a higher air/fuel ratio than that air/fuel ratio provided to inner Cyclone furnaces located further away from the side walls; and providing the balance of the total air for combustion to the OFA ports.

2. The method according to claim 1, comprising the steps of providing combustion air to the inner Cyclone furnaces at a stoichiometric ratio of about 0.90, providing combustion air to the outer Cyclone furnaces at a stoichiometric ratio of about 1.05, and providing the balance of the total air for combustion to the OFA ports.

3. The method according to claim 1, wherein the sum of the combustion air provided to the inner and outer Cyclone furnaces is at a stoichiometric ratio of about 0.95, and the balance of the total air for combustion is provided to the OFA ports.

4. A low $NO_x$ Cyclone furnace steam generator, comprising:

a steam generator having front, rear and side walls and a plurality of Cyclone furnaces for combusting a fuel, the Cyclone furnaces arranged along at least one of the front and rear walls of the steam generator, and a plurality of over fire air (OFA) ports arranged along at least one of, or both of, the front wall and the rear wall at a higher elevation above the plurality of Cyclone furnaces; and lower furnace air ports for providing a portion of the total air for combustion into the steam generator along said side walls, wherein said lower furnace air ports comprise means for directing the combustion air provided into the steam generator at a pitch angle Ø from about +45 degrees to about −45 degrees with respect to the horizontal, wherein said lower furnace air ports comprise means for directing the combustion air provided into the steam generator at a yaw angle θ up to about 30 degrees with respect to a line perpendicular to a plane of the front or rear walls, and wherein the low $NO_x$ Cyclone furnace steam generator further comprises means for providing a portion of the total air for combustion to the Cyclone furnaces, outer Cyclone furnaces adjacent the side walls being provided with a higher air/fuel ratio than that air/fuel ratio provided to inner Cyclone furnaces located further away from the side walls and means for providing the balance of the total air for combustion to the OFA ports.

5. The low $NO_x$ Cyclone furnace steam generator according to claim 4, wherein said lower furnace air ports comprise means for controlling at least one of air flow quantity, air flow velocity, and air flow direction through the lower furnace air ports to reduce furnace tube wastage in a lower region of the steam generator.

6. The low $NO_x$ Cyclone furnace steam generator according to claim 4, wherein the lower furnace air ports are provided adjacent the side walls.

7. The low $NO_x$ Cyclone furnace steam generator according to claim 4, wherein the lower furnace air ports are provided on at least one of the front and rear walls.

8. A low $NO_x$ Cyclone furnace steam generator, comprising:

a steam generator having front, rear and side walls and a plurality of Cyclone furnaces for combusting a fuel, the Cyclone furnaces arranged along at least one of the front and rear walls of the steam generator, and a plurality of over fire air (OFA) ports arranged along at least one of, or both of, the front wall and the rear wall at a higher elevation above the plurality of Cyclone furnaces, wherein the Cyclone furnaces each have a re-entrant throat and at least one of the Cyclone furnaces has a re-entrant throat diameter different from a re-entrant throat diameter of others of the Cyclone furnaces, wherein said lower furnace air ports comprise means for directing the combustion air provided into the steam generator at a pitch angle Ø from about +45 degrees to about −45 degrees with respect to the horizontal, wherein said lower furnace air ports comprise means for directing the combustion air provided into the steam generator at a yaw angle θ up to about 30 degrees with respect to a line perpendicular to a plane of the front or rear walls, and wherein at least one of the Cyclone furnaces located at an inner location has a re-entrant throat diameter which is smaller than a re-entrant throat diameter of at least one of the Cyclone furnaces located at an outer location.

9. The low $NO_x$ Cyclone furnace steam generator according to claim 8, further comprising lower furnace air ports provided adjacent the side walls for providing a portion of the total air for combustion into the steam generator along said side walls.

10. The low $NO_x$ Cyclone furnace steam generator according to claim 9, further comprising means for controlling at least one of air flow quantity, air flow velocity, and air flow direction through the lower furnace air ports to reduce furnace tube wastage in a lower region of the steam generator.

11. The low $NO_x$ Cyclone furnace steam generator according to claim 8, comprising means for providing a portion of the total air for combustion to the Cyclone furnaces, outer Cyclone furnaces adjacent the side walls being provided with a higher air/fuel ratio than that air/fuel ratio provided to inner Cyclone furnaces located further away from the side walls; and means for providing the balance of the total air for combustion to the OFA ports.

12. A low $NO_x$ Cyclone furnace steam generator, comprising:

a steam generator having front, rear and side walls and a plurality of Cyclone furnaces for combusting a fuel, the Cyclone furnaces arranged along at least one of the front and rear walls of the steam generator, and a plurality of over fire air (OFA) ports arranged along at least one of, or both of, the front wall and the rear at a higher elevation above the plurality of Cyclone furnaces, wherein the Cyclone furnaces adjacent the side walls have a direction of swirl selected to enhance sweeping of the side walls with combustion air to reduce the potential for localized reducing conditions, wherein said lower furnace air ports comprise means for directing the combustion air provided into the steam generator at a pitch angle Ø from about +45 degrees to about −45 degrees with respect to the horizontal, wherein said lower furnace air ports comprise means for directing the combustion air provided into the steam generator at a yaw angle θ up to about 30 degrees with respect to a line perpendicular to a plane of the front or rear walls, and wherein at least one of the Cyclone furnaces located at an inner location has a re-entrant throat diameter which is smaller than a re-entrant throat diameter of at least one of the Cyclone furnaces located at an outer location.

13. The low $NO_x$ Cyclone furnace steam generator according to claim 12, comprising means for providing a portion of the total air for combustion to the Cyclone furnaces, outer Cyclone furnaces adjacent the side walls being provided with a higher air/fuel ratio than that air/fuel ratio provided to inner Cyclone furnaces located further away from the side walls; and means for providing the balance of the total air for combustion to the OFA ports.

14. A low $NO_x$ Cyclone furnace steam generator, comprising:

a steam generator having front, rear and side walls and a plurality of Cyclone furnaces for combusting a fuel, the Cyclone furnaces arranged along at least one of the front and rear walls of the steam generator, and a plurality of over fire air (OFA) ports arranged along at least one of, or both of, the front wall and the rear wall at a higher elevation above the plurality of Cyclone furnaces, wherein the Cyclone furnaces each have a re-entrant throat and at least one of the Cyclone furnaces has a re-entrant throat diameter different from a re-entrant throat diameter of others of the Cyclone furnaces, wherein said lower furnace air ports comprise means for directing the combustion air provided into the steam generator at a pitch angle Ø from about +45 degrees to about −45 degrees with respect to the horizontal, wherein said lower furnace air ports comprise means for directing the combustion air provided into the steam generator at a yaw angle θ up to about 30 degrees with respect to a line perpendicular to a plane of the front or rear walls, and wherein the low $NO_x$ Cyclone furnace steam generator further comprises means for providing a portion of the total air for combustion to the Cyclone furnaces, outer Cyclone furnaces adjacent the side walls being provided with a higher air/fuel ratio than that air/fuel ratio provided to inner Cyclone furnaces located further away from the side walls and means for providing the balance of the total air for combustion to the OFA ports.

15. The low $NO_x$ Cyclone furnace steam generator according to claim 14, further comprising lower furnace air ports provided adjacent the side walls for providing a portion of the total air for combustion into the steam generator along said side walls.

16. The low $NO_x$ Cyclone furnace steam generator according to claim 15, further comprising means for controlling at least one of air flow quantity, air flow velocity, and air flow direction through the lower furnace air ports to reduce furnace tube wastage in a lower region of the steam generator.

17. A low $NO_x$ Cyclone furnace steam generator, comprising:

a steam generator having front, rear and side walls and a plurality of Cyclone furnaces for combusting a fuel, the Cyclone furnaces arranged along at least one of the front and rear walls of the steam generator, and a plurality of over fire air (OFA) ports arranged along at least one of, or both of, the front wall and the rear at a higher elevation above the plurality of Cyclone furnaces, wherein the Cyclone furnaces adjacent the side walls have a direction of swirl selected to enhance sweeping of the side walls with combustion air to reduce the potential for localized reducing conditions, wherein said lower furnace air ports comprise means for directing the combustion air provided into the steam generator at a pitch angle Ø from about +45 degrees to about −45 degrees with respect to the horizontal, wherein said lower furnace air ports comprise means for directing the combustion air provided into the steam generator at a yaw angle θ up to about 30 degrees with respect to a line perpendicular to a plane of the front or rear walls, and wherein the low $NO_x$ Cyclone furnace steam generator further comprises means for providing a portion of the total air for combustion to the Cyclone furnaces, outer Cyclone furnaces adjacent the side walls being provided with a higher air/fuel ratio than that air/fuel ratio provided to inner Cyclone furnaces located further away from the side walls and means for providing the balance of the total air for combustion to the OFA ports.

18. A low $NO_x$ Cyclone furnace steam generator, comprising:

a steam generator having front, rear and side walls and a plurality of Cyclone furnaces for combusting a fuel, the Cyclone furnaces arranged along at least one of the front and rear walls of the steam generator, and a plurality of over fire air (OFA) ports arranged along at least one of, or both of, the front wall and the rear wall at a higher elevation above the plurality of Cyclone furnaces; and lower furnace air ports for providing a portion of the total air for combustion into the steam generator along said side walls, wherein said lower furnace air ports comprise means for directing the combustion air provided into the steam generator at a pitch angle Ø from about +45 degrees to about −45 degrees with respect to the horizontal, wherein said lower furnace air ports comprise means for directing the combustion air provided into the steam generator at a yaw angle θ up to about 30 degrees with respect to a line perpendicular to a plane of the front or rear walls, and wherein at least one of the Cyclone furnaces located at an inner location has a re-entrant throat diameter which is smaller than a re-entrant throat diameter of at least one of the Cyclone furnaces located at an outer location.

19. The low $NO_x$ Cyclone furnace steam generator according to claim 18, wherein said lower furnace air ports comprise means for controlling at least one of air flow quantity, air flow velocity, and air flow direction through the lower furnace air ports to reduce furnace tube wastage in a lower region of the steam generator.

20. The low $NO_x$ Cyclone furnace steam generator according to claim 18, wherein the lower furnace air ports are provided adjacent the side walls.

21. The low $NO_x$ Cyclone furnace steam generator according to claim 18, wherein the lower furnace air ports are provided on at least one of the front and rear walls.

22. The low $NO_x$ Cyclone furnace steam generator according to claim 18, comprising means for providing a portion of the total air for combustion to the Cyclone furnaces, outer Cyclone furnaces adjacent the side walls being provided with a higher air/fuel ratio than that air/fuel ratio provided to inner Cyclone furnaces located further away from the side walls; and means for providing the balance of the total air for combustion to the OFA ports.

* * * * *